United States Patent [19]

McNair et al.

[11] Patent Number: 4,903,892

[45] Date of Patent: Feb. 27, 1990

[54] FRAGILE ARTICLE CARTON

[75] Inventors: William E. McNair, Durham; R. H. Allen, Burlington, both of N.C.

[73] Assignee: Mebane Packaging Corp., Mebane, N.C.

[21] Appl. No.: 233,139

[22] Filed: Aug. 17, 1988

[51] Int. Cl.[4] ..... B65D 5/48

[52] U.S. Cl. ..... 229/120.14; 206/420; 206/422; 229/120.11; 229/120.15

[58] Field of Search ..... 229/104, 120.11, 120.15, 229/120.16, 120.17, 120.18, 120.14, 40; 206/419, 420, 422, 429, 430, 521, 587

[56] References Cited

U.S. PATENT DOCUMENTS

| | | | |
|---|---|---|---|
| 3,055,574 | 9/1962 | Johnson | 229/40 |
| 3,197,112 | 7/1965 | Meyer-Jagenberg | 229/137 |
| 3,309,005 | 3/1967 | Pilger | 229/906 |
| 3,326,444 | 6/1967 | Farguhar et al. | 229/120.18 |
| 3,986,657 | 10/1976 | Angelini | 206/521 |
| 4,029,207 | 6/1977 | Gordon | 229/40 |
| 4,328,891 | 5/1982 | Elward | 206/427 |

FOREIGN PATENT DOCUMENTS

| | | | |
|---|---|---|---|
| 976920 | 10/1975 | Canada | 206/422 |
| 133242 | 2/1985 | European Pat. Off. | 206/419 |

*Primary Examiner*—Gary Elkins

*Attorney, Agent, or Firm*—Rhodes, Coats & Bennett

[57] ABSTRACT

A folding carton, having an integral, external cushioning structure including a pair of offset end wall panels, adapted to hold and cushion a packaged article.

16 Claims, 3 Drawing Sheets

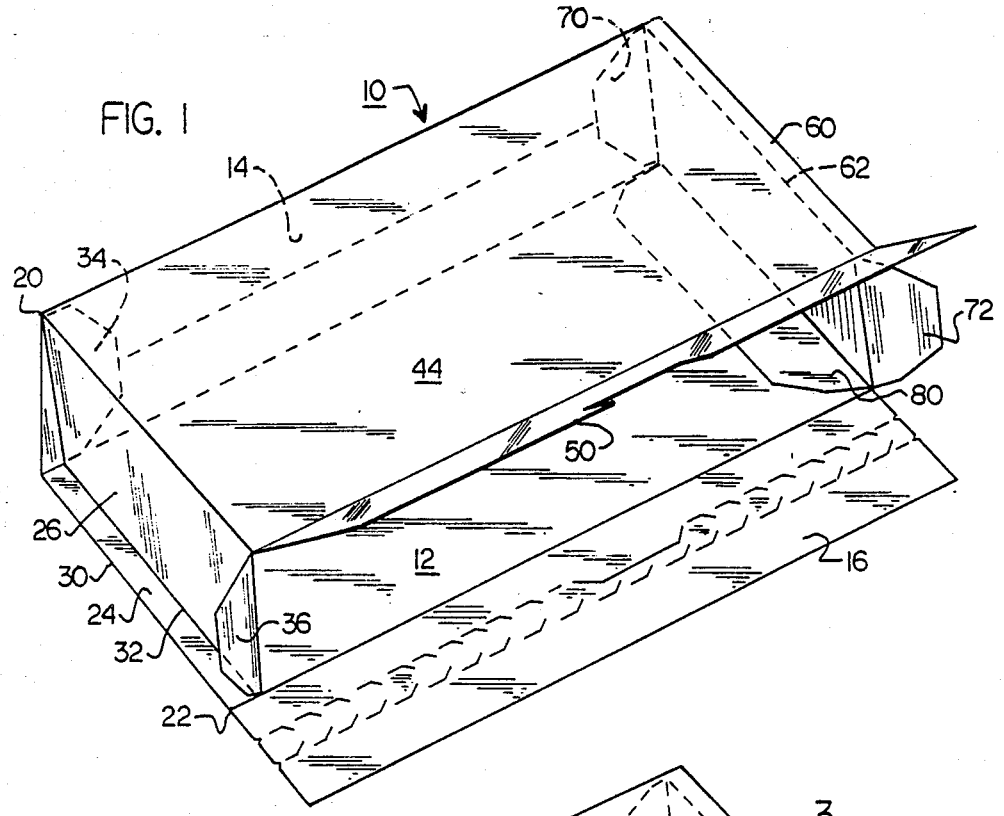
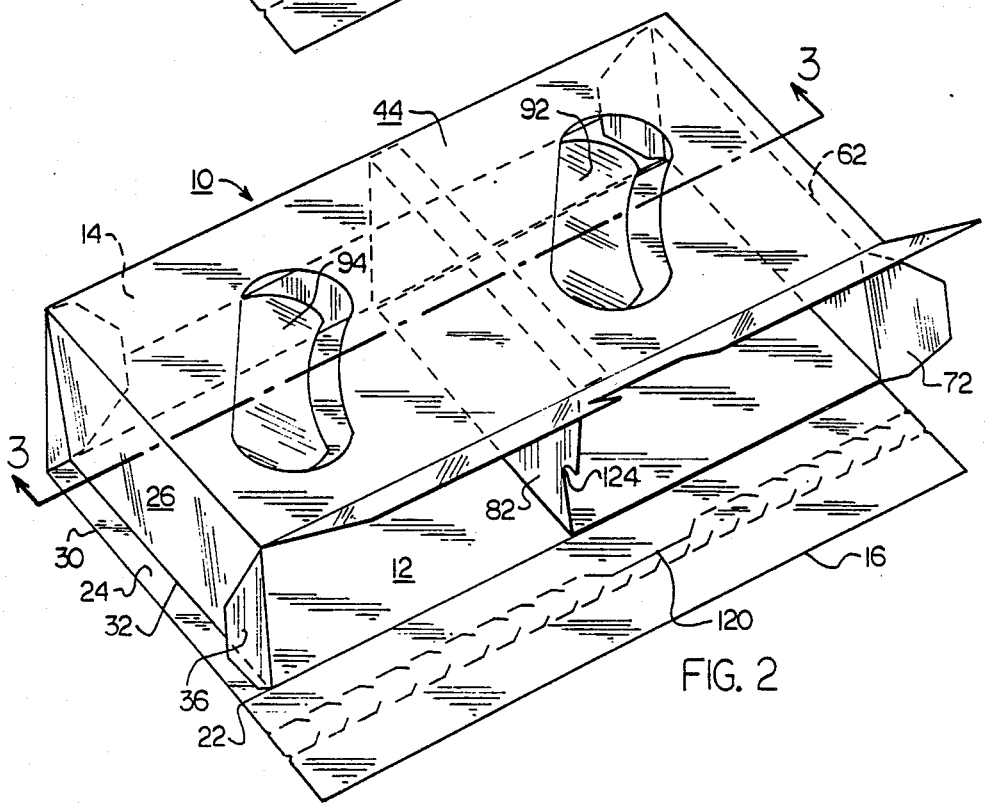
FIG. 2

FRAGILE ARTICLE CARTON

BACKGROUND OF THE INVENTION (1) Field of the Invention

The present invention relates generally to folding cartons and, more particularly, to a folding carton, having an integral, external cushioning structure including a pair of offset end wall panels, adapted to hold and cushion a packaged article.

(2) Description of the Prior Art

Packages for incandescent lightbulbs and other fragile articles are generally conventional corrugated sleeves. Paperboard cartons offer a number of advantages over such corrugated sleeves, such as a more attractive printed package, a greater security in that the lamps are not likely to fall out of the package as in the case of corrugated sleeves, the ability to stack large number of the packages on shelves and the like, and greater facility in packing and shipment since the unerected cartons can be folded completely flat. However, such cartons are not widely used, primarily because of the problem of breakage during shipment and, in particular, breakage which occurs when the carton is dropped.

Such breakage may occur regardless of the number of packaged articles therein, but it is particularly exacerbated in cartons containing two or more fragile packaged articles, and particularly, in cartons which the packaged articles lay one beside the other in one plane. This is because such cartons have a natural tendency to fall end-over-end when dropped and, consequently, are much more likely to land on one end after falling. Thus, in order to provide satisfactory cushioning, the carton must include some means of preventing the article from coming in contact with the end of the carton, i.e., the plane defined by the edges of the top, bottom, front and back panels.

A prior art search directed to the subject matter of this application in the U.S. Patent and Trademark Office disclosed the following Letters Patent: U.S. Pat. Nos. 1,630,497; 1,888,855; 2,569,733; 3,197,112; and 4,438,848.

U.S. Pat. Nos. 1,630,497, 1,888,855, and 2,569,733 are all exemplary of cartons in which lightbulbs or other similar fragile articles are contained. However, none of these prior patents disclose a carton, having an external cushioning structure comprising a pair of offset or recessed end walls, which is adapted to receive portions of the packaged article and cushion the article by preventing it from coming in contact with the plane defined by the edges of the top, bottom, front and back panels.

The 3,197,112 patent is exemplary of a milk carton having reverse folds along opposite edges thereof. However, the Z-folds construction taught by this patent is structured differently and for a different purpose than the offset end wall configurations formed by the present invention.

The 4,438,848 patent is directed to a folding carton having various recesses and cutouts for supporting a fragile article, however, otherwise it is not similar to the present invention.

It has thus become desirable to develop a folding carton, having an integral, external cushioning structure which includes a pair of offset end walls, adapted to hold and cushion a packaged article by preventing the article from being damaged by coming in contact with a plane defined by the edges of the top, bottom, front and back panels.

SUMMARY OF THE INVENTION

The present invention solves the aforementioned problems associated with the prior art by providing a folding carton for holding a fragile article and cushioning the article to prevent it from being damaged by coming in contact with one of the end walls of the carton. The carton of the present invention includes top and bottom wall panels separated by opposed front and rear side wall panels foldably joined thereto. The carton also includes a pair of end wall panels each foldably joined to one end edge of said top and bottom panels. Finally, the carton includes at least one pair of offset strips, each having one edge foldably joined to one end edge of a pair of end wall panels and an opposed edge foldably joined to the adjacent end edge of one of said top and bottom panels. Such construction causes at least one edge of the end walls to be recessed from the plane formed by the side edges of the top, bottom, front and rear walls.

In the preferred embodiment, the carton of the present invention also includes an integral, internal support structure for holding packaged articles in predetermined relationships to one another which includes a vertical divider which separates the interior chamber in the carton into substantially equal smaller chambers. Further, when more than one article is packaged in each chamber, at least one tab per chamber formed from the top or bottom panels extends downwardly or upwardly toward the other of said top or bottom panel. The tab is operable, when folded, to prevent surface contact between said pair of packaged articles. In the preferred embodiment, the top or bottom wall surrounding the tab is configured as to prevent direct contact between packaged articles contained within abutting cartons.

Accordingly, one aspect of the present invention is to provide a folding carton for holding a fragile article and cushioning the article to prevent it from damage during packing, shipping and/or storage caused by contact of a hard object with the end panels of the carton.

Another aspect of the present invention is to provide an internal folding carton having an internal support structure which can be adapted for holding two or more fragile articles and separating the articles to prevent them from being damaged by coming in contact with one another.

Another aspect of the present invention is to provide an internal structure for a cushioning carton which includes an oval-shaped tab formed from one of the surfaces of the cushioning carton and extending downward between at least one pair of articles and cushioning the articles to prevent damage by coming in contact with one another.

These and other aspects of the present invention will be more clearly understood after a review of the following description of the preferred embodiment of the invention, when considered with the drawings.

BRIEF DESCRIPTION OF THE DRAWINGS

FIG. 1 is a perspective view of a carton illustrating the features of the present invention, shown in the erected and open position.

FIG. 2 is a perspective of a carton illustrating the features of the preferred embodiment of the present invention, shown in the erected and open position.

DESCRIPTION OF THE PREFERRED EMBODIMENT(S)

Figure 3:
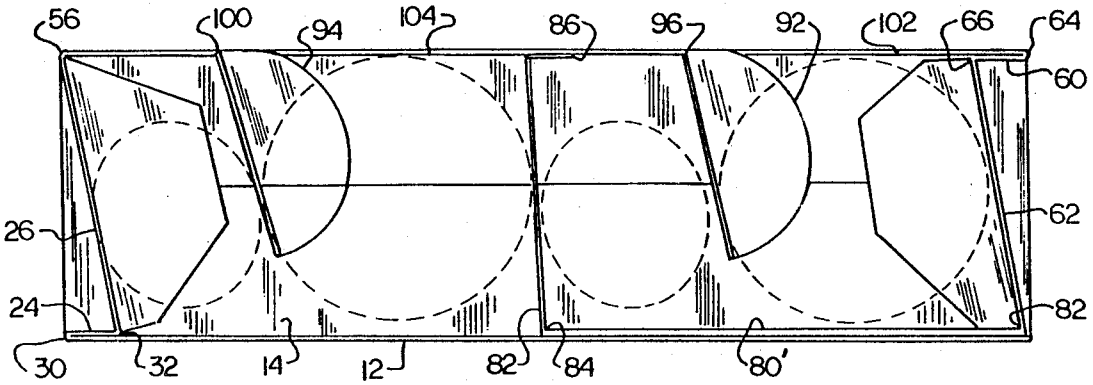
FIG. 3 is a vertical sectional view taken on line 3—3 of the structure illustrated in FIG. 2.

Referring now to the drawings in general and to FIG. 1 in particular, it will be understood that the illustrations are for the purpose of describing a preferred embodiment of the invention and are not intended to limit the invention hereto.

Figure 4:
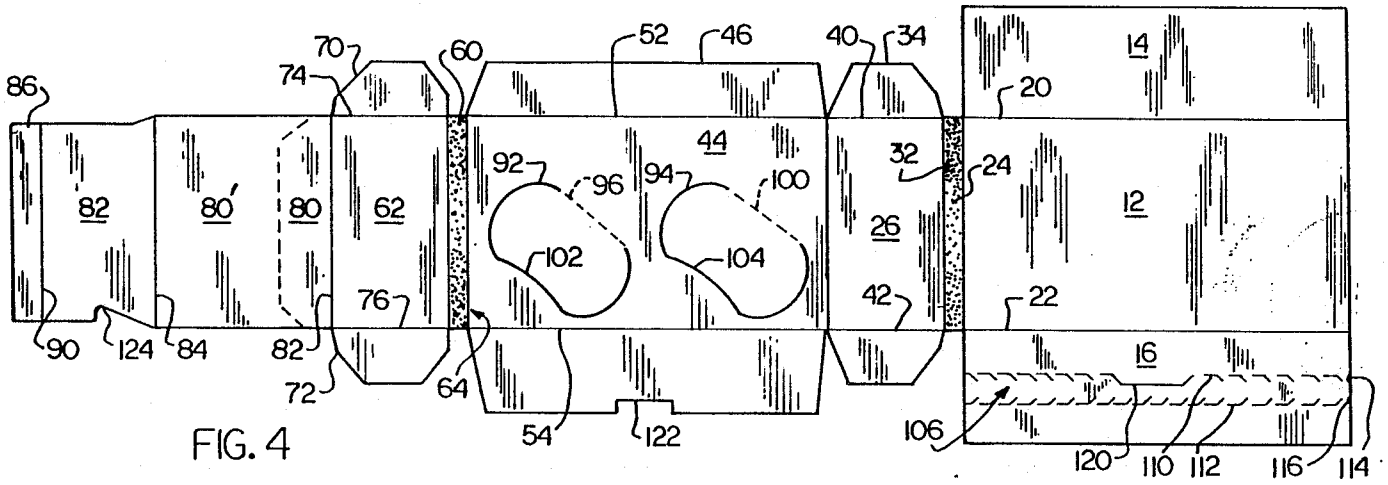
FIG. 4 is a plan view of the inner surface of a blank of foldable sheet material, from which the carton shown in the other views may be formed, illustrating the location of the inner glue strips.
Figure 5:
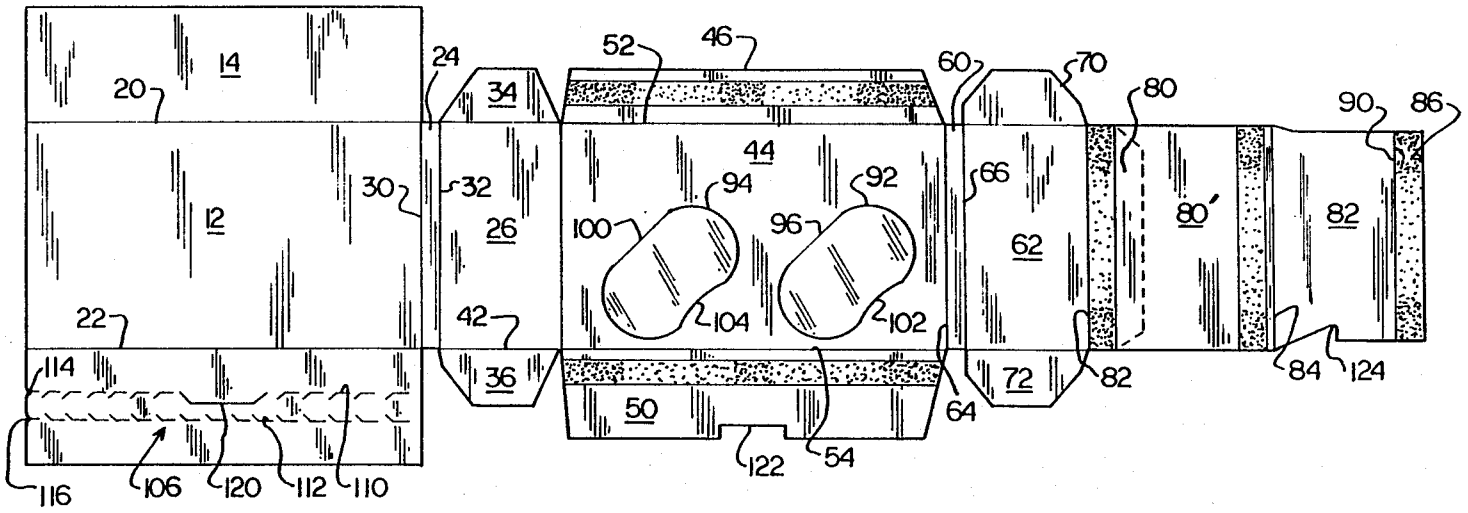
FIG. 5 is a plan view of the outer surface of the blank of foldable sheet material shown in FIG. 4, illustrating the location of the outer glue strips.

As best seen in FIG. 1, the novel carton, generally designated 10, includes an integral, external support structure adapted to hold and cushion a fragile article, such as electric lightbulbs. The carton 10, including the external cushioning structure, may be formed from a unitary blank foldable sheet material, such as paperboard, as illustrated in FIGS. 4 and 5. Bleached sulfate paperboard (Caliber 16) has found to perform satisfactorily for lightweight articles, such as lightbulbs. For heavier articles, a heavier paperboard (Caliber 24) may be required.

The body of the carton 10 includes a preferably rectangular bottom wall panel 12 having a first pair of opposed front and rear side wall panels 14 and 16, foldably joined to opposite side edges thereof, along fold lines 20 and 22, respectively.

A first offset strip 24 is located along one edge of the bottom wall panel 12 and adjacent to first end-wall panel 26, and foldably joined thereof along fold lines 30 and 32, respectively.

A first pair of end walls flaps 34, 36 are foldably joined on fold lines 40, 42, respectively, to opposite ends of end wall panel 26.

The upper body of carton 10 includes a preferably rectangle top wall panel 44 having a second pair of opposed front and rear sidewall panels 46 and 50, foldably joined to opposite side edges thereof, along fold lines 52 and 54, respectively.

A second offset strip 60 is located between the remaining edge of top wall panel 44 and a second end-wall panel 62 and is foldably joined thereto along fold lines 64 and 66, respectively. A second pair of corner connecting flaps 70, 72 are foldably joined on fold lines 74, 76 to opposite ends of second end wall panel 62.

A glue panel 80 is foldably joined along fold lines 82 to the remaining edge of second end wall panel 62.

As best seen in FIG. 2, in the preferred embodiment, glue panel 80, now designated 80' is extended to approximately half the width of the top and bottom wall panels 12, 44. A divider panel 82 is then foldably joined along fold line 84 to said panel. A glue panel 86, connected to the opposite edge of the divider panel 82 and folded along a fold line 90, is adapted to be secured in any desired manner, such as by adhesives, to the inner surface of top wall panel 44, thereby separating the interior of carton 10 into two chambers of substantially equal volume.

Again referring to FIG. 2, carton 10 is provided with tabs 92, 94, preferably at least two, and one on each side of carton 10. Tabs 92, 94 may be conventionally cut or punched out of the top wall panel 44 and extend within the body of carton 10 so that tabs 92, 94 passes over one of the pair of fragile articles in each partition volume and under the second article in each partition volume. Tabs 92 and 94 are foldably joined to top wall 44 along fold lines 96, 100, respectively.

As best seen FIG. 3, in the preferred embodiment, tabs 92, 94 are generally oval in shape and include inverted cuts 102, 104 in order that at least a portion of top wall panel 44 overlies the surface of the fragile article contained in the carton.

It can be readily appreciated that the tabs provide a means for viewing the packaged articles without the need for removing the articles from the carton.

Turning back to FIG. 2, in the preferred embodiment, first front wall panel 16 may include a tear strip, generally designated 106. Tear strip 106 includes a pair of perforated parallel lines 110, 122 which extend across the length of first front wall panel 16 and parallel to fold line 22. Indents 114, 116 are located at one end of tear strip 106, thereby facilitating the removal of tear strip 106.

In one embodiment, perforated line 110 is adapted to include a locking tab 120 which cooperates with the corresponding receiving tab 122 located along one edge of second front wall panel 50. In addition, a tab recess 124 may be made along front edge of divider panel 82 to better facilitate the use of the locking tab 120.

Referring back to FIG. 3, it can be seen that offset strips 24, 60 cooperate with end wall panels 26, 62 to prevent fragile articles contained in carton 10 from contacting the plane defined by the outer edges of the top, bottom, front and rear wall panels. This arrangement is operable to cushion the fragile articles by preventing contact with another surface, such as when the carton 10 is being dropped.

It would be appreciated that certain modifications and improvement will occur to those skilled in the art upon reading of the foregoing description. By way of example, a second offset strip could be added along the opposite edge of each end wall panel, thereby offsetting the wall parallel to the plane defined by the edges of the top, bottom, front and back panels. In addition, the width of the end panels between said strips could be increased, thereby causing the end panel to curve inwardly to provide a higher degree of cushioning. Finally, the surface of the end panels could include one or more additional fold lines extending parallel to the offset strip, thereby further offsetting the fragile article contained therein from the plane defined by the top, bottom, front and rear wall panel edges. It should be understood that all such modifications and improvements have been deleted herein for the sake of conciseness and readability but are properly within the scope of the following claims.

We claim:

1. A carton for packaging articles to provide an end cushion, comprising:

(a) bottom, top, front, and rear rectangular wall panels, said panels having interior and exterior surfaces;

(b) a pair of opposed end wall panels, the first of said end panels joined at one upper longitudinal edge to the side end edge of said top wall;

(c) a first offset strip joined at one edge to the lower longitudinal edge of said first end wall and joined at the opposite edge to the side end edge of said bottom wall, said offset strip being joined to the interior surface of said bottom wall to offset the lower longitudinal edge of said first end wall inwardly from the side edge of said bottom wall;

(d) the second of said end panels joined at one lower longitudinal edge to the side and edge of said bottom wall; and (e) a second offset strip joined at one edge to the upper longitudinal edge of said second end wall and joined at the opposite edge to the side end edge of said top wall, said offset strip being joined to the interior surface of said top wall to offset the lower longitudinal edge of said second end wall inwardly from the side edge of said top wall.

2. A carton according to claim 1, including an integral, internal support structure for holding said packaged articles in a predetermined relationship to one another, said structure including means for dividing the volume contained in said carton into substantially equal chambers.

3. A carton according to claim 2, wherein said means of dividing the volume contained in said carton into substantially equal chambers includes a vertical divider, said divider comprising:

(a) a first panel having one edge foldably joined to one end edge of said pair of end wall panels and extending parallel to and attached to the interior surface of one of said top and bottom panels; and (b) a second panel having one edge foldably joined to one end edge of first panel and extending therefrom at right angles to said first panel and engaging the interior surface of the other of said top and bottom panels.

4. A carton according to claim 3, where in said second panel is provided with a glue strip disposed at right angles thereto for engagement with the interior surface.

5. A carton according to claim 2, wherein said means of dividing the volume contained in said carton into substantially equal chambers includes at least one tab formed from material within one of said top and bottom panels and extending downwardly toward said other of said top and bottom panels, said tab being operable to prevent contact between said pair of packaged articles.

6. A carton according to claim 5, wherein said tab has a generally elongated oval shape, a portion of said tab being sufficiently inverted to provide an overlying region of material thereby preventing direct contact between said packaged articles contained within abutting cartons.

7. In a rectangular, parallelepiped, collapsible carton, formed of a unitary blank of foldable paperboard and having a bottom wall panel, a top wall panel, and a pair of end wall panels, for holding and cushioning a packaged article, the improvement comprising a single pair of offset strips each having one edge foldably joined to one end edge of each of said pair of end wall panels and an opposed edge foldably joined to an end edge of one of said top and bottom panels.

8. A carton for holding an cushioning a packaged article, comprising:

(a) a bottom wall panel having a first pair of opposed front and rear side walls panels foldably joined thereto;

(b) a top wall panel having a second pair of opposed front and rear side wall panels foldably joined thereto;

(c) a pair of end wall panels each foldably joined to one end edge of each of said top and bottom panels; and (d) at least one pair of offset strips each having one edge foldably joined to one end edge of said pair of end wall panels and an opposed edge foldably joined to an end edge of one of said top and bottom panels.

9. A carton according to claim 8, wherein said carton is formed of a unitary blank of foldable paperboard.

10. A carton according to claim 8, wherein each of said end wall panels further includes a pair of opposed end wall flaps foldably joined to the side edges thereof.

11. A carton according to claim 8, wherein the opposed edge of one of said pair of offset strips is foldably joined to the other end edge of said top panel and the opposed edge of the other of said pair of offset strips is foldably joined to the other end edge of said bottom panel.

12. A carton for holding and cushioning a packaged article, comprising:

(a) a bottom wall panel having a first pair of opposed front and rear side wall panels foldably joined thereto;

(b) a top wall panel having a second pair of opposed front and rear side wall panels foldably joined thereto;

(c) a pair of end wall panels each foldably joined to one end edge of each of said top and bottom panels; and (d) a pair of offset strips each having one edge foldably joined to one end edge of said pair of end wall panels and an opposed edge foldably joined to an edge edge one of said top and bottom panels.

13. A carton for holding and cushioning at least one pair of packaged articles, comprising:

(a) a bottom wall panel having a first pair of opposed front and rear side wall panels foldably joined thereto;

(b) a top wall panel having a second pair of opposed front and rear side wall panels foldably joined thereto;

(c) a pair of end wall panels; and (d) an integral, internal support structure for holding said packaged articles in a predetermined relationship to one another, said structure including means for dividing the volume contained in said carton into substantially equal chambers; said means for dividing the volume contained in said carton into substantially equal chambers including at least one tab formed from material within one of said top and bottom panels and extending downwardly toward said other of said top and bottom panels, said tab being operable to prevent contact between said pair of packaged articles;

wherein said tab has a generally elongated oval shape, a portion of said tab being sufficiently inverted to provide an overlying region of material in one of each top and bottom panels, thereby preventing direct contact between said packaged articles contained within abutting cartons.

14. A carton according to claim 13, wherein said means of dividing the volume contained in said carton into substantially equal chambers includes a vertical divider, said divider comprising:

(a) a first panel having one edge foldably joined to one end edge of said pair of end wall panels and extending parallel to and attached to one of said top and bottom panels; and (b) a second panel having one edge foldably joined to one end edge of said first panel and extending therefrom at right angles to said first panel and engaging the other of said top and bottom panels.

15. A carton according to claim 14, wherein said second panel is provided with a glue strip disposed at right angles thereto for engagement with the other of said top and bottom panels.

16. A carton for holding and cushioning a packaged article, comprising:

(a) a bottom wall panel having a first pair of opposed front and rear wall panels foldably joined thereto;

(b) a top wall panel having a second pair of opposed front and rear side wall panels foldably joined thereto;

(c) a pair of end wall panels each foldably joined to one end edge of said top and bottom panels;

(d) at least one pair of offset strips each having one edge of said pair of end wall panels and an opposed edge foldably joined to an end edge of one of said top and bottom panels; and (e) an integral, internal support structure for holding said packaged articles in a predetermined relationship to one another, said structure including means of dividing the volume contained in said carton into substantially equal chambers.

* * * * *